US010858885B2

(12) United States Patent
Walter-Seifart

(10) Patent No.: US 10,858,885 B2
(45) Date of Patent: Dec. 8, 2020

(54) SHAFT ASSEMBLY, COVERING OR PROTECTIVE DEVICE, AND MOUNTING KIT

(71) Applicant: acomax GmbH, Aichtal (DE)

(72) Inventor: Rolf Walter-Seifart, Filderstadt (DE)

(73) Assignee: acomax GmbH, Aichtal (DE)

( * ) Notice: Subject to any disclaimer, the term of this patent is extended or adjusted under 35 U.S.C. 154(b) by 307 days.

(21) Appl. No.: 15/945,536

(22) Filed: Apr. 4, 2018

(65) Prior Publication Data

US 2018/0291682 A1 Oct. 11, 2018

(30) Foreign Application Priority Data

Apr. 11, 2017 (DE) ..... 10 2017 107 826

(51) Int. Cl.
*E06B 9/68* (2006.01)
*E06B 9/40* (2006.01)
(Continued)

(52) U.S. Cl.
CPC ..... *E06B 9/68* (2013.01); *E04F 10/0648* (2013.01); *E05F 15/00* (2013.01); *E06B 9/171* (2013.01);
(Continued)

(58) Field of Classification Search
CPC ... E06B 9/68; E06B 9/72; E06B 9/407; E06B 9/402; E06B 9/50; E06B 9/40; E06B 9/171; E06B 2009/1713
(Continued)

(56) References Cited

U.S. PATENT DOCUMENTS 1,232,729 A * 7/1917 Starn ..... E06B 9/50 248/268
3,099,916 A * 8/1963 Rosenbaum ..... E06B 9/44 160/323.1
(Continued)

FOREIGN PATENT DOCUMENTS

DE 3920200 A1 1/1991
DE 9421948 U1 3/1998
(Continued)

*Primary Examiner* — Katherine W Mitchell
*Assistant Examiner* — Jeremy C Ramsey
(74) *Attorney, Agent, or Firm* — Jason H. Vick; Sheridan Ross, PC

(57) ABSTRACT

A shaft assembly for a protective or closing device comprises a hollow-shaped hollow section body and a drive unit. The shaft assembly is arranged to be mounted between a first support bearing and a second support bearing. The hollow section body is rotatable about longitudinal axis thereof and arranged to accommodate a curtain or a panel. The drive unit is at least partially accommodated in the hollow section body. The drive unit comprises an output for rotatably driving the hollow section body. The hollow section body comprises a first end and a second end and extends between the first support bearing and the second support bearing. At least at the first end or at the second end of the hollow section body, a connecting sleeve is provided. A biasing element is arranged between the hollow section body and the connecting sleeve. The connecting sleeve is axially displaceable relative to the hollow section body against a force applied by the biasing element.

14 Claims, 7 Drawing Sheets

(51) Int. Cl.
*E06B 9/171* (2006.01)
*E04F 10/06* (2006.01)
*E05F 15/00* (2015.01)

(52) U.S. Cl.
CPC ..... *E06B 9/40* (2013.01); *E05Y 2201/706* (2013.01); *E06B 2009/1713* (2013.01); *E06B 2009/407* (2013.01)

(58) Field of Classification Search
USPC ..... 248/292.12, 292.13, 292.14, 266, 269
See application file for complete search history.

(56) References Cited

U.S. PATENT DOCUMENTS 3,340,922 A * 9/1967 Anderson ..... E06B 9/44 160/326
5,105,871 A 4/1992 Baud et al.
6,215,265 B1 4/2001 Wolfer et al.
8,408,486 B2 * 4/2013 Di Stefano ..... E06B 9/42 242/407
8,453,708 B2 * 6/2013 Rysholt ..... E06B 9/174 160/323.1
9,957,752 B2 * 5/2018 Bohlen ..... E06B 9/50
2009/0308543 A1 * 12/2009 Kates ..... E06B 9/44 160/5
2018/0355664 A1 * 12/2018 Schorling ..... E06B 9/40

FOREIGN PATENT DOCUMENTS

DE 19933124 A1 4/2000
DE 102005034063 B3 4/2007
DE 102014003494 A1 9/2015
EP 0479719 B1 4/1994
EP 1746244 B1 11/2011
GB 2339820 2/2000

* cited by examiner

SHAFT ASSEMBLY, COVERING OR PROTECTIVE DEVICE, AND MOUNTING KIT

CROSS REFERENCE TO RELATED APPLICATIONS

This application claims priority from German patent application 10 2017 107 826.6, filed on Apr. 11, 2017. The entire content of that priority application is fully incorporated by reference herewith.

BACKGROUND

The present disclosure relates to a shaft assembly for a covering or protective device, in particular for a roller shutter, a roller door or an awning. The present disclosure further relates to a covering or protective device that is provided with a respective shaft assembly, and to a mounting kit for flexibly mounting a shaft assembly.

GB 2,339,820 B discloses an end plug assembly for coupling a roller of an architectural covering to a mounting bracket, said end plug assembly comprising a cylindrical body engageable with an end of said roller, said body having inner and outer axial ends. and an axially extending, first central cavity, open at said outer axial end; a telescopic member, adapted for limited telescopic movement in said first central cavity between an outer axial end position where said telescopic member engages said bracket, and an inner axial end position where said telescopic member is disengaged from said bracket; and a spring within said first central cavity to urge said telescopic member towards said outer axial end position.

EP 1 746 244 B1 discloses a roller blind with a closure element which can be wound on a reel shaft which is at its ends provided with receiving elements receivable by support members of lateral support devices, the roller blind comprising in the area of at least one end thereof an extendable extension piston holding the associated receiving element and being fixable in at least one axial fixing position, wherein the extension piston is received by a sleeve insertable into the reel shaft, such sleeve supporting a push-out spring associated with the extension piston, with the said sleeve comprising a slotted inner sleeve embraced by the push-out spring, wherein the inner sleeve is engaged by a projecting nose of the extension piston standing out relative to the abutting surface of the extension piston in a direction opposite the push-out direction, the abutting surface being associated with the push-out spring, with the extension piston being provided with spring-action tongues having radial projections which engage the slots of the inner sleeve.

U.S. Pat. No. 5,105,871 A discloses a retractor device for roller curtains, roller shutters or the like, comprising a retractor tube and an output that is coupled to the retractor tube in a torque-proof fashion, wherein a motor is provided in the interior of the retractor tube, the motor being supported on one side at a wall. The motor is designed as a tubular motor.

Shaft assemblies of the aforementioned kind may generally be referred to as winding devices, and are typically provided for winding or unwinding in a defined manner a covering unit in the form of a so-called curtain, which is provided with various links, in order to cover or expose an opening.

A feature of the design according to U.S. Pat. No. 5,105,871 A as described above is that the drive unit is barely or not visible from the outside, and that the drive unit requires almost no additional installation space. On the one hand, this simplifies the retrofitting of older covering devices (roller shutters, blinds, segment doors, or roller doors), since no major structural changes are required.

On the other hand, however, it has been observed that the mounting of such a shaft assembly is still very complex. This applies both to new installations and to retrofitting and repairs. A mounting dimension for the shaft assembly is usually defined by the existing opening (window, door or the like) as well as by corresponding clearance spaces in the wall and/or by set dimensions of a box. Generally, only little space is provided in an axial direction (along the longitudinal axis of the hollow section body), solely due to the fact that, for example, the curtain of a roller shutter must be so wide that in cooperation with the corresponding lateral guide rails, a complete covering of the opening is possible.

In the case of retrofitting or reassembly, the shaft assembly may be mounted in a partially or completely unwound state so that, for example, the hollow section body is at least partially (radially) accessible. However, in case of repair, there is often a state in which the shaft assembly is completely or almost completely wound up. Hence, the curtain is wrapped around the hollow section body. The hollow section body is therefore not accessible.

Significant temperature fluctuations (day/night and/or summer/winter) are to be expected during operation of the protective or covering device. This may result in considerable temperature expansions in the components used, which may have a negative effect on the operating behavior. Furthermore, it has been observed that the ease of movement of the device could be impaired, for example, by the setting behavior of buildings and/or other external influences. It is conceivable, for example, that the device is mounted and/or adjusted with high precision and smooth running during initial installation. However, if changes occur due to external influences, smooth running is no longer provided. This may result in an increased wear, increased energy consumption and a reduced service life.

SUMMARY

In view of this, it is an object of the present disclosure to present a shaft assembly for a covering or protective device, in particular for a roller shutter, roller door or an awning, which is easy to install and which reduces the risk of incorrect installation and incorrect adjustments.

It is a further object of the present disclosure to present a shaft assembly which can be installed and mounted quickly, for example by dispensing with the need for additional work steps or tools.

It is a further object of the present disclosure to present a shaft assembly which can be safely installed and mounted with low-error, which preferably prevents spontaneous loosening.

It is a further object of the present disclosure to present a shaft assembly that is suitable, at least in specific embodiments, for new installations as well as for retrofitting.

It is a further object of the present disclosure to present a shaft assembly that is designed in such a way that it can be easily adapted to given installation spaces, in particular to given installation widths.

It is a further object of the present disclosure to present a shaft assembly that is designed in such a way that simple assembly and disassembly is possible even in the event of poor accessibility, for example in a roller shutter box or window opening.

It is a further object of the present disclosure to present a shaft assembly that is self-adjusting, especially with regard to its axial position. This shall further contribute to a simplification and/or an at least partial elimination of assembly and, in particular, adjustment work, at least in specific embodiments.

It is a further object of the present disclosure to present a covering or protective device, in particular a roller shutter, a roller door or an awning, which is provided with such a shaft assembly.

It is a further object of the present disclosure to present a mounting kit for flexibly mounting a shaft assembly, which is particularly suitable for retrofitting and/or for repair purposes.

In accordance with a first aspect, these and other objects are achieved by a shaft assembly for a covering or protective device, comprising a hollow section body arranged to be mounted between a first support bearing and a second support bearing, and a drive unit that is at least partially arranged in the hollow section body, wherein the hollow section body is rotatable about its longitudinal axis and arranged to accommodate a curtain or a panel of the covering or protective device, wherein the drive unit comprises an output for rotatably driving the hollow section body, wherein the hollow section body comprises a first end facing the first support bearing and a second end facing the second support bearing, wherein a connecting sleeve is provided at least at one of the first end and the second end of the hollow section body, wherein a biasing element is arranged between the hollow section body and the connecting sleeve, and wherein the connecting sleeve is axially displaceable relative to the hollow section body against a force applied by the biasing element.

In accordance with a further aspect of the present disclosure, these and other objects are achieved by a shaft assembly for a covering or protective device, in particular for a roller shutter, a roller door or an awning, wherein the shaft assembly comprises a hollow shaped hollow section body that is arranged to be rotated about its longitudinal axis, and that is arranged to receive a curtain or a panel, and a drive unit that is arranged at least partially in the hollow section body, wherein the shaft assembly is arranged to be mounted between a first support bearing and a second support bearing, wherein the drive unit comprises a drive for a rotation drive of the hollow section body, wherein the hollow section body extends between the first support bearing and the second support bearing, and comprises a first and facing the first support bearing and a second and facing the second support bearing, wherein at least at one of the first and the second end of the hollow profile part, a connecting sleeve is provided that is arranged to be coupled to the hollow section body, wherein a biasing element is arranged between the hollow section body and the connecting sleeve, and wherein the connecting sleeve is axially displaceable relative to the hollow section body against a force applied by the biasing element.

In accordance with a further aspect, these and other objects are achieved by a shaft assembly for a covering or protective device, comprising a hollow section body arranged to be mounted between a first support bearing and a second support bearing, and a drive unit that is at least partially arranged in the hollow section body, wherein the hollow section body is rotatable about its longitudinal axis and arranged to accommodate a curtain or a panel of the covering or protective device, wherein the drive unit comprises an output for rotatably driving the hollow section body, wherein the hollow section body comprises a first end facing the first support bearing and a second end facing the second support bearing, wherein a connecting sleeve is provided at least at one of the first end and the second end of the hollow section body, wherein a biasing element is arranged between the hollow section body and the connecting sleeve, wherein the connecting sleeve is axially displaceable relative to the hollow section body against a force applied by the biasing element, wherein a pressure piece is arranged at the hollow section body, wherein the biasing element is supported at the pressure piece, wherein the pressure piece is coupled to a tube segment of the connecting sleeve, wherein the biasing element is arranged as a spring that is formed concentrically with respect to the tube segment of the connecting sleeve, and that is arranged outside of the tube segment, and wherein the tube segment provides an axial guide for the pressure piece and the biasing element.

In accordance with exemplary aspects and embodiments of the present disclosure, it is namely proposed to arrange the connecting sleeve, which is arranged between the hollow section body and the support, to be displaceable interaction to a preloading force so that the connecting sleeve may be at least partially inserted into the hollow section body for the purpose of assembly or disassembly. This has the effect that after unloading, the shaft assembly may easily be engaged or snapped in (outwardly) into a provided (axial) installation space. This generally applies in both a completely wound up state of the hollow section body, and also in a completely or partially unwound state of the hollow section body. In certain embodiments, the arrangement comprising the connecting sleeve, which may be displaced against the force of the biasing element, allows assembly or disassembly without the absolute necessity of making the hollow section body radially accessible in order to fasten screws, fastening pins or the like radially. This is no basically longer necessary.

Another effect of the above exemplary embodiment is that the shaft assembly is self-aligning, at least in certain embodiments. Since a biasing element is arranged between the hollow section body and the connecting sleeve, which applies an axial preloading force, the shaft assembly automatically adapts itself—axially seen—to actual installation conditions when the fitter or worker no longer applies an axially acting force.

In the context of the present disclosure, the shaft assembly may generally be referred to as a furling unit or winding device. In the context of the present disclosure, the term "assembly" includes both assembly and disassembly. Repair work, maintenance work and the like are also encompassed.

In the context of the present disclosure, embodiments and arrangements of the shaft assembly are illustrated with reference to roller shutters. This is not to be understood to be limiting, and in particular this does not exclude a respective use with awnings or similar devices for sun protection, rain protection, privacy protection and the like, in certain embodiments.

Generally, the connecting sleeve may also be referred to as a bearing sleeve or telescopic sleeve. The connecting sleeve and the hollow section body are at least partially telescopic/extendable. In this way, the connecting sleeve serves as an assembly aid, since axial "compression" of the shaft assembly is made possible in a simple manner, so that a positive fit may be achieved by snapping in at the first support and the second support.

The hollow section body is not necessarily rotationally symmetric or even cylindrical. Instead, the hollow section body is generally designed as a polygonal profile, such as a square profile, hexagonal profile or octagonal profile. In the alternative, the hollow section body may have a round profile or a round profile provided with a groove. Further profile shapes of other types are also conceivable.

The exemplary embodiment described above allows, so to say, a self-aligned or even floating support of the hollow section body between the first support bearing and the second support bearing. This applies for instance in the case that both at the first end and also at the second end of the hollow section body a connecting sleeve is provided, which may be inserted into the hollow section body against a preloading force.

The first end and/or the second end of the hollow section body may be supported directly or mediately at the first bearing and second support bearing, respectively. By way of example, the first support bearing serves as a rotation bearing for the hollow section body. Accordingly, the second support bearing may be designed as a rotation anchor for the drive unit. In accordance with this embodiment, for example, the second end of the hollow section body is coupled to the drive unit via the connecting sleeve, whereas the drive unit is fixed to the second support bearing. At least the first support, which is provided with a rotation bearing or may be coupled thereto, for example, may be referred to as a bearing shield.

It goes without saying that the use of ordinal numbers, such as first end, second end, first support, second support, etc. is for illustrative and distinction purposes only. Terms such as "first", "second", and the like shall not imply a compulsory sequence, valuation or weighting. The scope of the present disclosure encompasses both embodiments of the shaft assembly comprising two connecting sleeves in the sense of the above arrangements, and embodiments comprising only a single connecting sleeve which is coupled to a corresponding biasing element which is interposed between the connecting sleeve and the hollow section body. Accordingly, embodiments of the shaft assembly are conceivable, which only have a second connecting sleeve at the second end of the hollow section body.

In this respect, the terms "first" and "second" are chosen arbitrarily and primarily for the purpose of distinction. Accordingly, instead of "first element" and "second element", the terms "right element" and "left element" could be used for the purpose of distinction, although this shall not be understood to be limiting either.

In the context of the present disclosure, the term "first end" refers to the end of the hollow section body that is associated with the first support, which is designed as a rotation bearing for the hollow section body. Accordingly, the term "second end" refers to the end of the hollow section body that is assigned to the second support on the motor or drive side. In exemplary embodiments in accordance with the present disclosure, elements are described which may be provided both at the first end and at the second end. In this respect, the respective particular designation "first" or "second" must not be understood in a limiting sense.

The drive unit is arranged as a so-called tubular motor, which may also comprise a reduction gear, in addition to an electric motor. The drive unit may also comprise a control module. The drive unit may also include sensors. At the drive unit, for instance at a drive housing, a bearing for the second end of the hollow section body may be formed.

According to an exemplary embodiment of the shaft assembly, the connecting sleeve comprises a collar on which the biasing element is supported at its end facing away from the hollow section body. The collar may also be described as a flange. The collar usually extends radially outwards.

In accordance with a further embodiment of the shaft assembly, at the hollow section body, a pressure piece may be mounted, at which the biasing element is supported, wherein the pressure piece is arranged to be coupled to a tube segment of the connecting sleeve. Hence, this allows the biasing element to be supported axially at the collar of the connecting sleeve and at the pressure piece. The pressure piece increases the axial end face of the hollow section body so that sufficient axial contact surface is available for the biasing element. This has the effect that the hollow section body may still be thin-walled and arranged in the form of an endless profile.

In accordance with a further embodiment of the shaft assembly, the tube segment of the connecting sleeve dips axially into the hollow section body with increasing compression of the biasing element. In this way, the entire shaft assembly may be axially compressed or telescoped to allow assembly.

In the assembled or pre-assembled state, the biasing element is seated on the tube segment of the connecting sleeve between the collar of the connecting sleeve and the pressure piece, which may also be accommodated on the connecting sleeve.

In accordance with a further embodiment of the shaft assembly, the pressure piece is arranged to be connected to the hollow section body in a rotationally fixed manner, wherein the pressure piece is also arranged to be coupled to the connecting sleeve in a rotationally fixed manner. For example, the pressure piece may comprise a profile that is adapted to an inner profile of the hollow section body to allow rotation. Rotary driving elements, such as bars and corresponding grooves, may be formed between the pressure piece and the hollow section body. This has the effect that when the hollow section body is rotated during winding or unwinding of the curtain, the connecting sleeve is also rotated in essentially the same direction and in the same amount. Thus, there is no (substantial) relative rotation between the connecting sleeve, the pressure piece and the hollow section body.

The precise rotary coupling and/or rotary position coupling is important for limit switches and similar safety devices, which are used, for instance, for anti-pinch protection functions. In this way, unfavorable friction that could occur if the biasing element is partially twisted about the longitudinal axis may also be avoided. The hollow section body is still mounted in a defined manner between the first support and the second support.

In accordance with a further embodiment of the shaft assembly, a snaplock connection is provided between the pressure piece and the connecting sleeve to couple the pressure piece axially displaceable and loss-proof to the connecting sleeve. In certain embodiments, this involves an interposing of the biasing element. Hence, in certain embodiments, this allows a pre-assembly of such a mounting unit, including the connecting sleeve, the pressure piece and the biasing element. In certain embodiments, the snaplock connection is formed in such a way that the preloading force of the biasing element cannot inadvertently cause the snap connection to be released.

In certain embodiments, the subassembly referred to as mounting unit described above is suitable for retrofitting existing units, since ideally no or only insignificant changes are required at the outer interfaces, i.e. at the first support bearing, the second support bearing, the hollow section body and/or the drive unit.

In accordance with a further exemplary embodiment of the shaft assembly, the biasing element is arranged as a spring that is concentric to the tube segment of the connecting sleeve and outside the tube segment, wherein the tube segment provides a guide for the pressure piece and the biasing element. In this way, the biasing element may be designed simply and cost-effectively as a compression spring. In accordance with this embodiment, the biasing element does not penetrate into the interior of the hollow section body if the connecting sleeve is at least partially inserted into the interior of the hollow section body. Furthermore, this design prevents buckling or other evasion of the biasing element.

According to a further exemplary design of the shaft assembly, the tube segment and the pressure piece are provided with corresponding rotary driving elements. In certain embodiments, the rotary driving elements may have the form of grooves and bars.

In accordance with a further exemplary embodiment of the shaft assembly, the connecting sleeve, the biasing element and the pressure piece do not or only slightly protrude beyond an outer circumference or an envelope curve of the hollow section body. In other words, the ability of the hollow section body to receive the curtain or other winding is not impaired. An envelope curve around the hollow section body may be understood as a circle or cylinder that connects the outer points of the hollow section body, which is usually designed as a polygonal profile. In certain embodiments, the connecting sleeve, the biasing element and the pressure piece do not protrude radially outwards beyond this envelope circle or envelope cladding. The tubular design of the shaft assembly is retained. Furthermore, the ability to wrap the hollow section body with the curtain and/or the panel is maintained.

In accordance with a further exemplary embodiment of the shaft assembly, the first end of the hollow section body is supported via a first connecting sleeve at the first support, wherein the connecting sleeve comprises a receptacle in the form of a bearing seat or an axle socket. In certain embodiments, the connecting sleeve comprises a combined receptacle that provides both a bearing seat and an axle socket.

This connecting sleeve is referred to as the first connecting sleeve for differentiation purposes herein. For coupling the first connecting sleeve with the first support, two options are basically conceivable. On the one hand, the connecting sleeve itself may have a bearing seat in which a bearing, such as a rolling bearing (ball bearing, roller bearing or the like), may be accommodated. Thus, for example, a bolt would be formed on the first support bearing onto which the connecting sleeve with the bearing accommodated in the bearing seat could be fitted.

According to an alternative embodiment, the bearing or rolling bearing is mounted directly on the first support bearing via its outer circumference. Accordingly, an axle is provided which is inserted into the axle socket of the connecting sleeve. The connecting sleeve may then be inserted into the bearing at the bearing seat via the axle.

In certain embodiments, the end face of the connecting sleeve facing the first support bearing is arranged as a bearing seat as well as an axle socket. This reduces the variety of parts, manufacturing costs and logistics expenses. The combined receptacle provides a two-in-one solution for the first support bearing.

Accordingly, the bearing seat is axially offset from the axle socket, wherein a seat diameter of the bearing seat is larger than a mounting recess of the axle socket, for example. With respect to the end of the first connecting sleeve, which faces the first support bearing, first the bearing seat is provided, with the axle socket adjoining the bearing seat and being axially displaced to the rear.

In accordance with a further exemplary embodiment of the shaft assembly, the second end of the hollow section body is supported by a second connecting sleeve at the drive unit and by the drive unit at the second support bearing. In other words, the second connecting sleeve is interposed between the hollow section body and the drive unit. Also with this arrangement, at least in some embodiments, no essential changes at the established and known interfaces of the drive unit and the hollow section body are required. It goes without saying that these exemplary embodiments do not exclude deviating embodiments in which a different geometry is deliberately selected.

In accordance with a further exemplary embodiment of the shaft assembly, the drive unit comprises a rotary driver which is coupled to the hollow section body for motion entrainment, wherein the drive unit is coupled to a rotary position sensor unit. In certain embodiments, the rotary position sensor unit detects a rotary position of the rotary driver and compares it with a rotary position of the output.

In other words, the drive unit serves as a (second) bearing for the hollow section body, since the hollow section body may rotate about the drive unit (or around a housing of the drive unit) via the connecting sleeve. In this way, it is also possible to implement anti-jamming detection or anti-pinch protection when the rotational position at the output is compared with the rotational position of the rotary driver. Differences in rotary position may be detected via the rotary position sensor unit. Significant differences in the rotational position of the rotary driver and the output are indicators of an oblique position of the curtain.

In accordance with a further exemplary embodiment of the shaft assembly, the rotary driver comprises at least one rotary driving element that is arranged to be coupled to the connecting sleeve for rotary driving. Also in accordance with this design, the rotary movement of the hollow section body is transmitted to the connecting sleeve via the pressure piece, so that the rotary driving element is connected to the hollow section body in a substantially rotationally fixed manner, even though the connecting sleeve and the pressure piece are interposed between the rotary driving element and the hollow section body.

A mounting unit is also provided at the second end, i.e. for coupling the hollow section body to the drive unit, which is referred to as the second mounting unit herein for differentiation purposes. The second assembly unit comprises a connecting sleeve, a pressure piece and a biasing element, which is interposed therebetween. In certain embodiments, the pressure piece is mounted via a snap-lock connection on a tube segment of the connecting sleeve.

In accordance with a further exemplary embodiment of the shaft assembly, the first end is supported at the first support bearing, wherein the second end is supported at the drive unit, wherein the drive unit is supported at the second support bearing, wherein the output of the drive unit is coupled to the hollow section body via an adapter piece for rotatory driving, and wherein the adapter piece is arranged inside the hollow section body. The force applied to transmit the drive torque to the hollow section body may be applied in a central area between the first end and the second end. Both at the first end and at the second end of the hollow section body, a compensating movement and a telescopic movement may take place to simplify assembling. It is not necessary to fix the adapter piece axially relative to the hollow section body.

In certain embodiments, the drive unit comprises a motor and a gear unit, which are arranged in a drive housing. The drive housing also serves as a housing for the rotary driver of the drive unit, which provides a rotation bearing for the hollow section body, wherein the coupling involves an interposition of a connection sleeve and a pressure piece. The rotary movement of the hollow section body may be transmitted via the rotary driver.

According to another aspect of the present disclosure, there is presented a mounting kit for flexibly mounting a shaft assembly, for instance a furling unit for a covering or protection device, the mounting kit comprising:

a first connecting sleeve associated with a first support bearing and a first end of a hollow section body and/or a second connecting sleeve associated with a drive unit and a second end of the hollow section body, at least one pressure piece which may be inserted both between the first connecting sleeve and the hollow section body and between the second connecting sleeve and the hollow section body, the pressure piece enabling rotary driving between the hollow section body and the respective connecting sleeve, and at least one biasing element, for instance a biasing element that is arranged as a helical spring, which is arranged to be accommodated both between a collar of the first connecting sleeve and the associated pressure piece and also between a collar of the second connecting sleeve and the associated pressure piece, wherein the first connecting sleeve and the second connecting sleeve are arranged to be inserted for assembly purposes into the hollow section body against the force of the biasing element.

Also in this way, simple assembling and disassembling is enabled with little tooling efforts.

In accordance with this embodiment, a connecting sleeve, a pressure piece and a biasing element each form an assembly unit. Overall, a first assembly unit and a second assembly unit are conceivable, wherein the first assembly unit is assigned to the first end and the second assembly unit to the second end of the hollow section body.

Embodiments of the mounting kit are conceivable, which comprise only the first mounting unit or the second mounting unit. Effects of the present disclosure may be already apparent when only one telescopic connecting sleeve is used, either at the first end or at the second end. If two connecting sleeves, i.e. two assembly units, are provided, even greater axial movements are possible to simplify assembly or disassembly. Furthermore, the use of two mounting units of that kind results in a "floating" self-balancing axial bearing of the shaft assembly. The pre-tensioning forces applied by the two pre-tensioning elements counteract each other.

By way of example, one and the same spring may be used for both the first assembly unit and the second assembly unit. In certain embodiments, one and the same pressure piece may be used both at the first end and at the second end of the hollow section body.

By way of example, at least the collar and the tube segment of the connecting sleeves are identical. In other words, at least one radial outer contour of the connecting sleeves is identical, so that the use of tools with interchangeable inserts for manufacturing is conceivable.

By way of example, the pressure piece, the first connecting sleeve and the second connecting sleeve are manufactured by injection molding. Nevertheless, additive or generative manufacturing is also conceivable, for example using 3D printing processes. This may apply to spare parts, retrofit solutions and other batches with small production sizes, in certain embodiments.

With regard to the first connecting sleeve, which may be coupled to the first end of the hollow section body, the end facing away from the hollow section body and facing the first support may be configured such that, on the one hand, a bearing seat and, at the same time, an axle socket or axle support are provided there. Hence, this means that even there, with one and the same design, an adaptation to different types of support bearings (bearing shields) may be provided.

In accordance with another aspect of the present disclosure there is presented a covering or protection device, for instance a roller shutter or a roller door, the device comprising:

a first support bearing, a second support bearing, and a shaft assembly arranged in accordance with one of the exemplary embodiments described herein, which is mounted between the first support bearing and the second support bearing, wherein the shaft assembly is for the purpose of assembly axially telescopic against a preloading force.

It is to be understood that the previously mentioned features and the features mentioned in the following may not only be used in a certain combination, but also in other combinations or as isolated features without leaving the spirit and scope of the present disclosure.

BRIEF DESCRIPTION OF THE DRAWINGS

Further features and advantages of the present disclosure are disclosed by the following description of a plurality of exemplary embodiments, with reference to the drawings, wherein.

DESCRIPTION OF EXEMPLARY EMBODIMENTS

Figure 1:
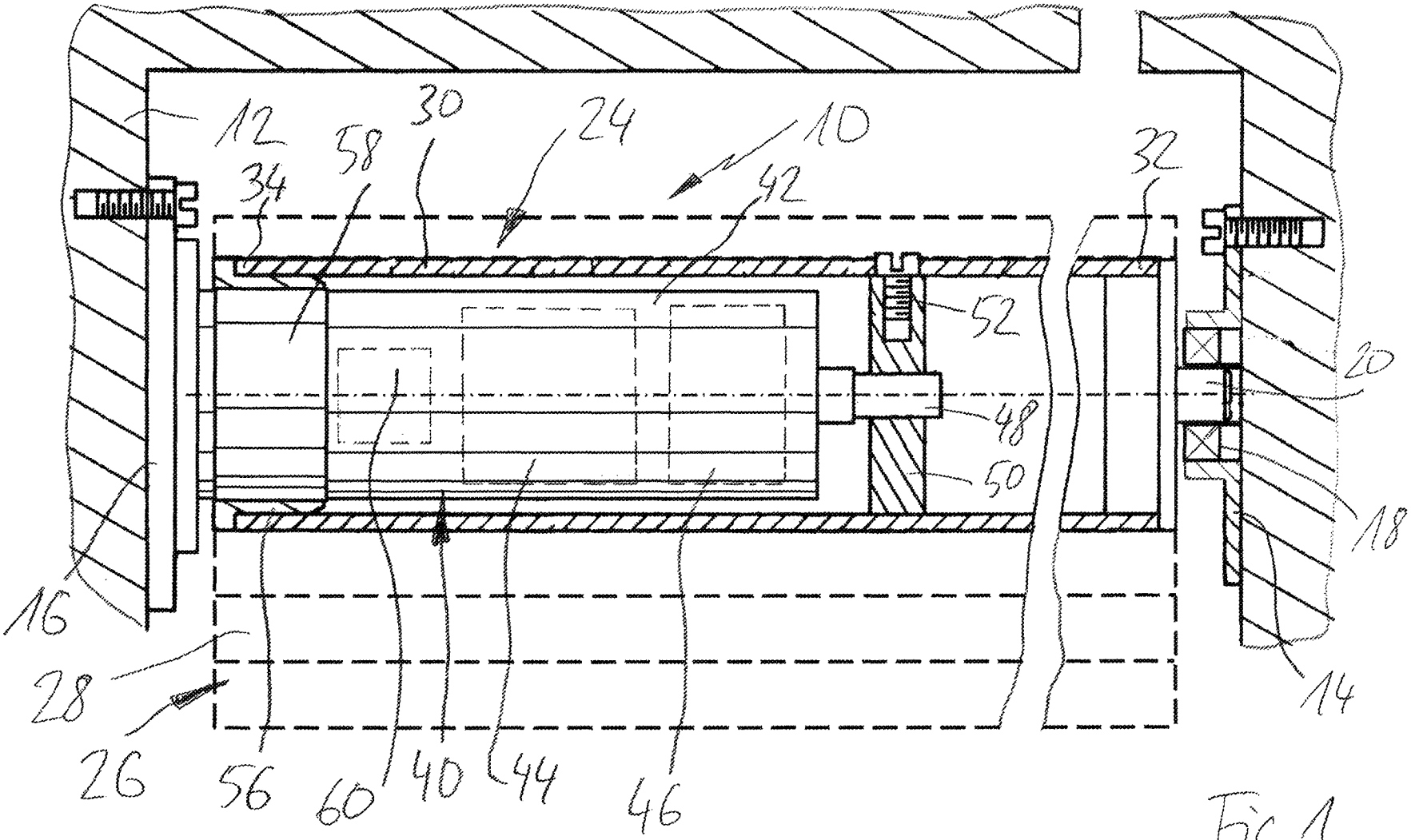
FIG. 1 is a longitudinal sectional view through a general embodiment of a covering device that is arranged as a roller shutter, in the area of a shaft assembly.

FIG. 1 illustrates with reference to a longitudinal sectional view an exemplary design of a covering device 10. The covering device 10 is designed as a roller shutter, roller door, awning or a segment door/articulated door, for example. The covering device 10 is fixedly attached to a wall 12. It goes without saying that the covering device 10 may also be mounted on the ceiling, via boxes and in a similar manner.

FIG. 1 illustrates a conventional design of the covering device 10, which is described for example in U.S. Pat. No. 5,105,871 A.

Exemplary embodiments of shaft assemblies according to the present disclosure are elucidated in detail and described with reference to FIGS. 2 to 15, wherein reference is made to the exemplary installation setting illustrated in FIG. 1, respectively.

In FIG. 1 the covering device 10 comprises a first support bearing 14 and a second support bearing 16, which are mounted on opposite walls 12 in the exemplary embodiment illustrated. At the first support bearing 14, a rolling bearing 18 is provided that supports an axis 20.

The covering device 10 comprises a shaft assembly 24 accommodated between the first support bearing 14 and the second support bearing 16. The shaft assembly 24 is supported via the axis 20 at the rolling bearing 18 at the first support bearing 14. The shaft assembly 24 is used to accommodate, wind up and unwind a curtain 26. The curtain 26 comprises several links 28 which are articulated with one another. Accordingly, the curtain 26 may be wound around or unwound from a hollow section body 30 of the shaft assembly 24. Alternative embodiments of device 10 involve a configuration as a protective device, for instance as an awning for sun protection, privacy protection, rain protection or the like. Accordingly, it is basically conceivable to wind and unwind a panel, such as a fabric panel or film panel, instead of the curtain 26.

The hollow section body 30 comprises a first end 32 and a second end 34. The first end 32 faces the first support bearing 14. The second end 34 faces the second support bearing 16.

There is further provided a drive unit 40 that comprises a drive housing 42. The drive housing 42 is fixed to the second support bearing 16 in a torque-proof manner. In other words, the second support bearing 16 serves as torque support for a motor 44 of the drive unit 40. The motor 44 is mounted in the drive housing 42. The drive unit 40 also includes a dear unit 46. The motor 44 is coupled to an output 48, which is also referred to as out-turn, via the 46 gearbox. The output 48 is coupled to a driver 50, which is connected to the hollow section body 30 around its longitudinal axis for rotary driving. For this purpose, a fastening means is provided, for example in the form of a screw 52, which couples the driver 50 with the hollow section body 30. It goes without saying that fastening with screw 52 or a similar fastening means is only required in some cases.

The drive unit 40 is supported at the second support bearing 16. When motor 44 is activated, an output movement of the motor is transmitted via the gear 46 to the output 48 and via the driver 50 to the hollow section body 30. The curtain 26 may then be wound or unwound, depending on the direction of rotation of the motor 44.

The hollow section body 30 is further supported at its second end 34 via a bush 56 at the drive unit 40. A rotary driver 58 is formed on the drive housing 42, which provides a bearing for the bush 56 and thus for the hollow section body 30.

In other words, two rotation bearings are provided for the hollow section body 30, on the one hand at the first end 32 the rolling bearing 18, which is coupled to the first support bearing 14. In addition, the rotary driver 58 is provided at the drive unit 40, with which the hollow section body 30 is rotatably mounted via the bushing 56. Thus, the second end 34 is supported by the rotary driver 58 and the drive housing 42 by the second support bearing 16.

At least in some exemplary embodiments, the drive unit 40 further comprises a rotary position sensor unit 60, which is configured to detect and monitor a rotational position of the output 48 and a rotational position of the rotary driver 58. This has the effect that blockages, unequal loads and other unusual operating conditions may be detected. In the event that the rotational positions of the rotary driver 58 and the output 48 do not change synchronously and differences in rotational position are detected, a potentially faulty operating state is indicated. Then, for example, the motor 44 may be switched off via a controller.

The motor 44, the gear unit 46 and the rotary position sensor unit 60 are shown in FIG. 1 for illustrative purposes only symbolically by means of dashed blocks in the drive housing 42.

The assembly of the shaft assembly 24 according to FIG. 1 is relatively effortful, as there is only little space between the walls 12 to fixedly attached the shaft assembly 24, probably even in a fully wound state, to the first support bearing 14 and to the second support bearing 16 or to release it therefrom. Therefore, very complex and possibly cumbersome assembling/disassembling may be necessary. Boxes such as roller shutter boxes, awning boxes and the like are often used as housings for the shaft assembly 24. Mounting openings of the boxes are generally even shorter in the longitudinal direction than the longitudinal extension of the shaft assembly 24, which is present in the operational state.

With reference to several exemplary embodiments illustrated in FIGS. 2 to 15, measures for simplifying installation are explained hereinbelow. According to at least some exemplary embodiments, the covering device 10 shown in FIG. 1 may be easily upgraded or retrofitted accordingly.

Figure 2:
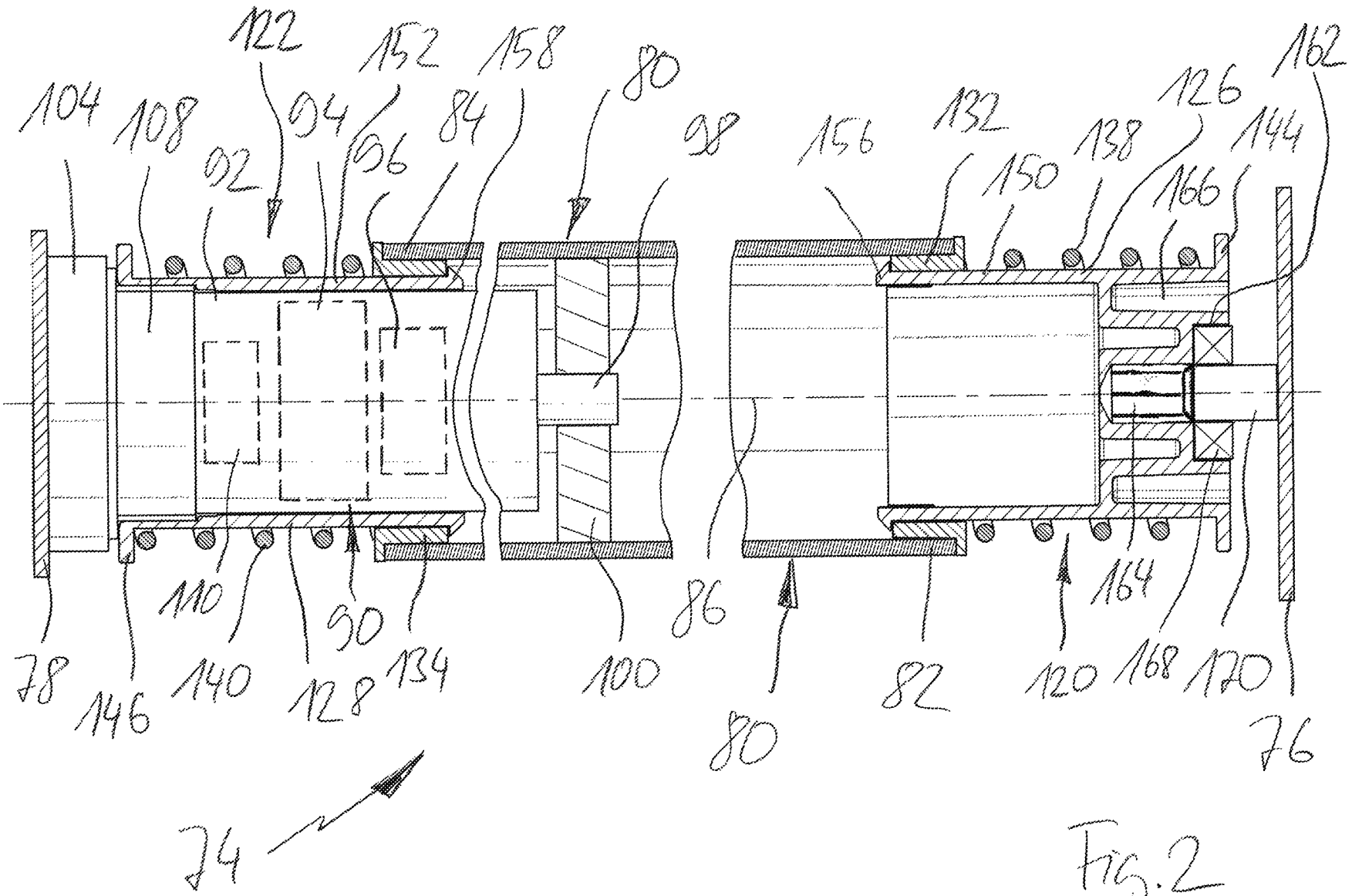
FIG. 2 is a broken view of an embodiment of a shaft assembly according to the present disclosure.

FIG. 2 illustrates a shaft assembly 74 for a covering device 10; refer to FIG. 1 in this context. The shaft assembly 74 may be mounted between a first support bearing 76 and a second support bearing 78. The shaft assembly 74 comprises a hollow section body 80 comprising a first end 82 facing the first support bearing 76. Furthermore, the hollow section body 80 comprises a second end 84 facing the second support bearing 78. The first end 82 and the second end 84 of the hollow section body 80 are facing away from each other. The hollow section body 80 is arranged to be rotated about its longitudinal axis 86 in order to wind up and unwind a curtain 26 (compare again FIG. 1). In this way a roller shutter, a roller door or the like may be implemented.

The shaft assembly 74 further comprises a drive unit 90, which is arranged as a so-called tubular motor unit. The drive unit 90 comprises a drive housing 92, in which a motor 94 is arranged. The motor 94 is coupled to an output 98 via a dear unit 96. The output 98 cooperates with a driver 100 to form a rotary drive for the hollow section body 80.

The drive unit 90 is coupled to the second support bearing 78 via a connector 104 in a torque-proof manner. The hollow section body 80 is at its first end 82 (mediately) coupled to the first support bearing 76. The first support bearing 76 defines a first rotation bearing for the hollow section body 80. The hollow section body 80 is at its second end 84 (mediately) mounted to a rotary driver 108. The rotary driver 108 provides a second rotation bearing for the hollow section body 80. Thus, a first rotation bearing is assigned to the first end 82 and a second rotation bearing to the second end 84. Between the first end 82 and the second end 84, rotation takes place via the driver 100.

Also at the drive unit 90, a rotary position sensor 110 is provided, which is arranged to detect a rotational position of the output 98 and a rotational position of the rotary driver 108 in order to detect possible deviations. In this way, a safety switch-off may be implemented. It goes without saying that exemplary embodiments of the shaft assembly 74 may also be implemented without such position detection.

In FIG. 2, too, the motor 94, the gear unit 96 and the rotary position sensor unit 110 are merely indicated for illustrative purposes by dashed blocks in the drive housing 92. It goes without saying that the drive unit 90 may also include a control unit, interfaces, supply lines, control lines and the like.

With regard to the elements described above, the shaft assembly illustrated in FIG. 2 is basically similar to the shaft assembly 24 illustrated in FIG. 1. This ensures easy interchangeability and/or upgradeability. In contrast to the type of mounting between the first support bearing 14 and the second support bearing 16 shown in FIG. 1, the shaft assembly 74 is mounted between the first support bearing 76 and the second support bearing 78 in FIG. 2 using further elements which considerably simplify assembly and disassembly.

A first assembly unit 120 is assigned to the first end 82 of the hollow section body 80. A second assembly unit 122 is assigned to the second end 84 of the hollow section body 80. The first assembly unit 120 comprises a connecting sleeve 126, a pressure piece 132 and a biasing element 138. Accordingly, the elements may be referred to as the first connecting sleeve 126, first pressure piece 132 and first biasing element 138.

The second assembly 122 comprises a connecting sleeve 126, a pressure piece 134 and a biasing element 140. Accordingly, the elements may be referred to as second connecting sleeve 128, second pressure piece 134 and second biasing element 140.

The first assembly unit 120 extends between the first end 82 and the first support bearing 76. The second assembly unit 122 extends between the second end 84 and the rotary driver 108 that is mounted at the drive housing 92 and/or the connecting piece 104 at the second support bearing 78.

The connecting sleeve 126 projects at least partially at the first end 82 into an interior of the hollow section body 80. The connecting sleeve 126 comprises a collar 144 at its end facing the first support bearing 76. A tube segment 150 is adjoining the collar 144 towards the hollow section body 80. The biasing element 138, which is for instance designed as a helical spring, extends between the collar 144 and the pressure piece 132.

Furthermore, a snap-lock connection is formed between the connecting sleeve 126 and the pressure piece 132, which is formed, for example, by snap hooks 156 provided on the tube segment 150. Hence, a positive locking of the pressure piece 132 on the first connecting sleeve 126 is provided. The pressure piece 132 is coupled to an end face of the hollow section body 80. The biasing element 138 pushes the pressure piece 132 and the collar 144 apart from one another.

In the joined state according to FIG. 2, the biasing element 138 pushes the pressure piece 132 towards the hollow section body 80. However, if a respective force is applied, the connecting sleeve 126 may be at least partially inserted deeper into the hollow section body 80. In other words, the connection between the hollow section body 80 and the connecting sleeve 126 may be telescoped, at least partially. The biasing element 138 ensures that the connecting sleeve 126 is pushed out again if no corresponding force is applied from the outside.

Similarly, the connecting sleeve 128 cooperates with the second end 84 of the hollow section body 80. The connecting sleeve 128 is at least partially inserted into the hollow section body 80. The pressure piece 134 is supported at an end face of the hollow section body 80, which faces the second support bearing 78. The connecting sleeve 128 comprises a collar 146 which faces the second support bearing 78. Adjoining the collar 146, a tube segment 152 extends towards and at least partially into the hollow section body 80.

The biasing element 140 extends between the collar 146 and the pressure piece 134. The biasing element 140 is again arranged as a coil spring (compression spring), for instance. The biasing element 140 pushes the collar 146 away from the hollow section body 80. However, a snap-lock connection is also provided between the pressure piece 134 and the connecting sleeve 128, which is formed, for example, by snap hooks 158 provided on the tube segment 152. This ensures a positive locking of the pressure piece 134 on the tube segment 152.

Also the connecting sleeve 128 may be moved further into the hollow section body 80 against the force applied by the biasing element 140. Thus, the connection between the hollow section body 80 and the connecting sleeve 128 may also be at least partially telescoped, provided that a respective force is applied. In the mounted state as shown in FIG. 2, the biasing element 140 pushes the collar 146 and thus the connecting sleeve 128 towards the second support bearing 78.

As already described above in connection with FIG. 1, the drive unit 90 of the exemplary embodiment illustrated in FIG. 2 is also mounted to the second support bearing 78 in a torque-proof manner via the connecting piece 104. The rotary driver 108 acts (mediately) as a rotation bearing for the second end 84 of the hollow section body 80.

The first end 82 of the hollow section body 80 is (mediately) supported at the first support bearing 76. To this end, the connecting sleeve 126 comprises a bearing seat 162 on its end face facing the first support bearing 76. An axle socket 164, which may also be referred to as an axle receptacle, adjoins the bearing seat 162. Recesses 166 are also provided, primarily for manufacturing-related purposes. A bearing 168 is arranged in the bearing seat 162, which is supported by a bolt 170, which is arranged as a fixed part of the first support bearing 76.

In accordance with an exemplary embodiment, the connecting sleeve 126 is arranged both to support a bearing via the bearing seat 162 and to accommodate an axle via the axle socket 164. Accordingly, the connecting sleeve 126, as shown in FIG. 2, may be coupled with a support bearing 76 comprising a fixed bolt 170. In the alternative, however, it is also possible to couple the connecting sleeve with a support bearing 14, which comprises an integrated rolling bearing 18, in accordance with the embodiment as shown in FIG. 1. In other words, an axis 20, refer again to FIG. 1, could be accommodated in the axle socket 164 (referred to FIG. 2) of the connecting sleeve 126. Hence, assembly would also be possible in this case. One and the same part is suitable for two different types of attachment.

The exemplary embodiment of the shaft assembly 74 illustrated with reference to the longitudinal section shown in FIG. 2 is elucidated in more detail with reference to FIGS. 3, 4 and 5. It is emphasized again that each of the two assembly units 120, 122 may also be used in isolation. Even if only one of the two ends 82, 84 of the hollow section body 80 is coupled with a corresponding assembly unit 120, 122, considerable simplifications may be achieved during assembly and disassembly.

Figure 3:
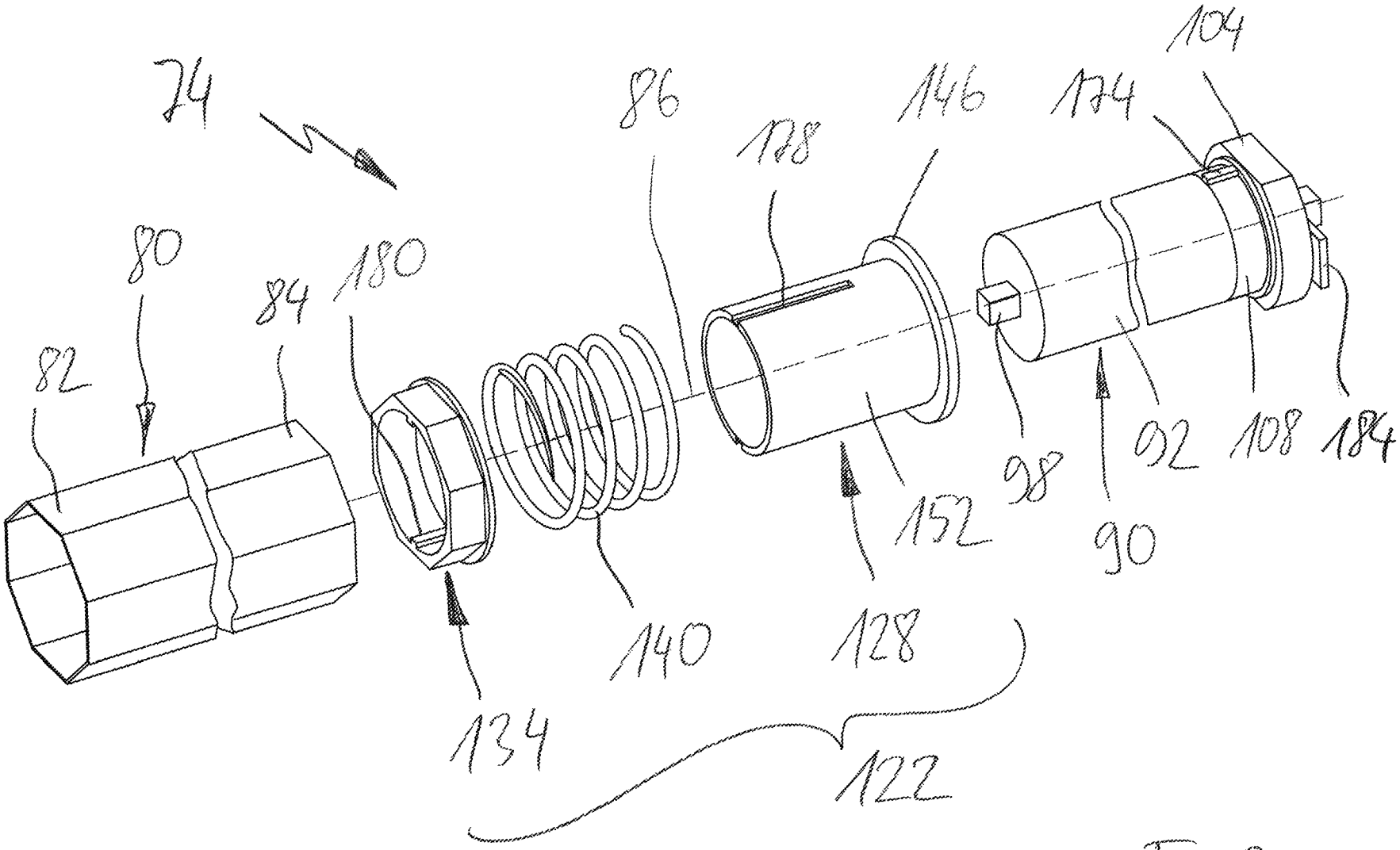
FIG. 3 is a perspective broken partial view of a peripheral area of a shaft assembly according to the arrangement shown in FIG. 2.

FIG. 3 illustrates an exploded, broken partial view of shaft assembly 74, and relates for instance to an area at the second end 84 of the hollow section body 80 and the associated mounting unit 122. FIG. 4 and FIG. 5 illustrate lateral views in a preassembled state, wherein the connecting sleeve 128 in FIG. 5 is inserted deeper into the hollow section body 80, compared to the illustration in FIG. 4. The state of FIG. 5 may be achieved by applying a correspondingly huge force to the collar 146. In this state, coupling with the second support bearing 78 (see FIG. 2) is enabled.

FIG. 3 shows that the drive unit 90 is inserted through the mounting unit 122 into the hollow section body 80. As described above, it is possible that the rotary driver 108 is rotated together with the rotary movement of the hollow section body 80. This is even necessary when using monitoring devices to protect against jamming (blocking protection), and/or to detect end positions.

For this purpose, the pressure piece 134, which is partially inserted into the second end 84 of the hollow section body 80, is provided with a profile adapted to the profile of the hollow section body 80. A rotary driver element 174 is formed on the rotary driver 108, which is arranged as a bar, for instance. A corresponding rotary driving element 176 is provided on the connecting sleeve 128 (not shown in FIG. 3), which is designed as a groove conferences. Hence, the connecting sleeve 128 may be coupled for rotary driving with the rotary driver 108 in the region of the collar 146, for instance, wherein the rotary driving elements 176, 174 engage one another.

In the region of the tube segment 152, the connecting sleeve 128 is provided with a rotary driving element 178, which is arranged as a groove. A corresponding rotary driving element 180 is provided on the pressure piece 134, which is arranged as a web. The rotary driving elements 178, 180 engage one another when the pressure piece 134 is joined with the connecting sleeve 128, for instance with the tube segment 152 of the connecting sleeve 128.

The longitudinal extension of the groove-shaped rotary driving element 178 is significantly greater than the longitudinal extension of the web-like rotary driving element 180. Hence, it is taken into account in this way that an axial relative movement takes place between the pressure piece 134 and the connecting sleeve 128 when the biasing element 140 is compressed.

The rotary driving elements 174, 176, 178, 180 extend in a longitudinal direction that is parallel to the longitudinal axis 86. In this way, the rotation entrainment or the defined rotational position between the elements involved is ensured.

The exemplary embodiment shown in FIG. 3 is not provided with a snap hook 158 for the connecting sleeve 128. However, this is not to be understood to be limiting. Nonetheless, it is conceivable to join the connecting sleeve 128 and the pressure piece 134 with one another even without a snap connection, since at least in the mounted state (see FIG. 2) the connecting sleeve 128 cannot move out so far that the pressure piece 134 may come loose.

At an end thereof that faces the second support bearing 78, the drive unit 90 of connecting piece 104 is provided with a mounting piece 184, which may engage a suitable recess in the second support bearing 78.

Figure 4:
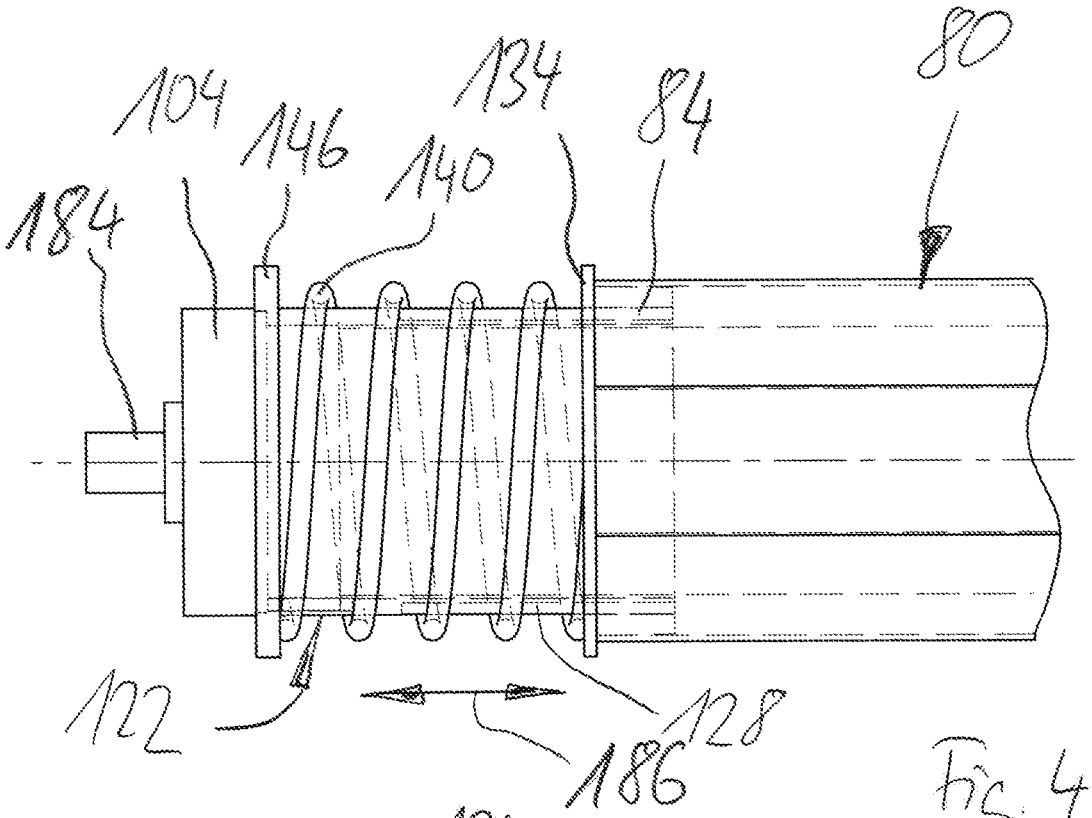
FIG. 4 is a lateral partial view of a mounting unit for a hollow section body of a shaft assembly in a first, expanded state.
Figure 5:
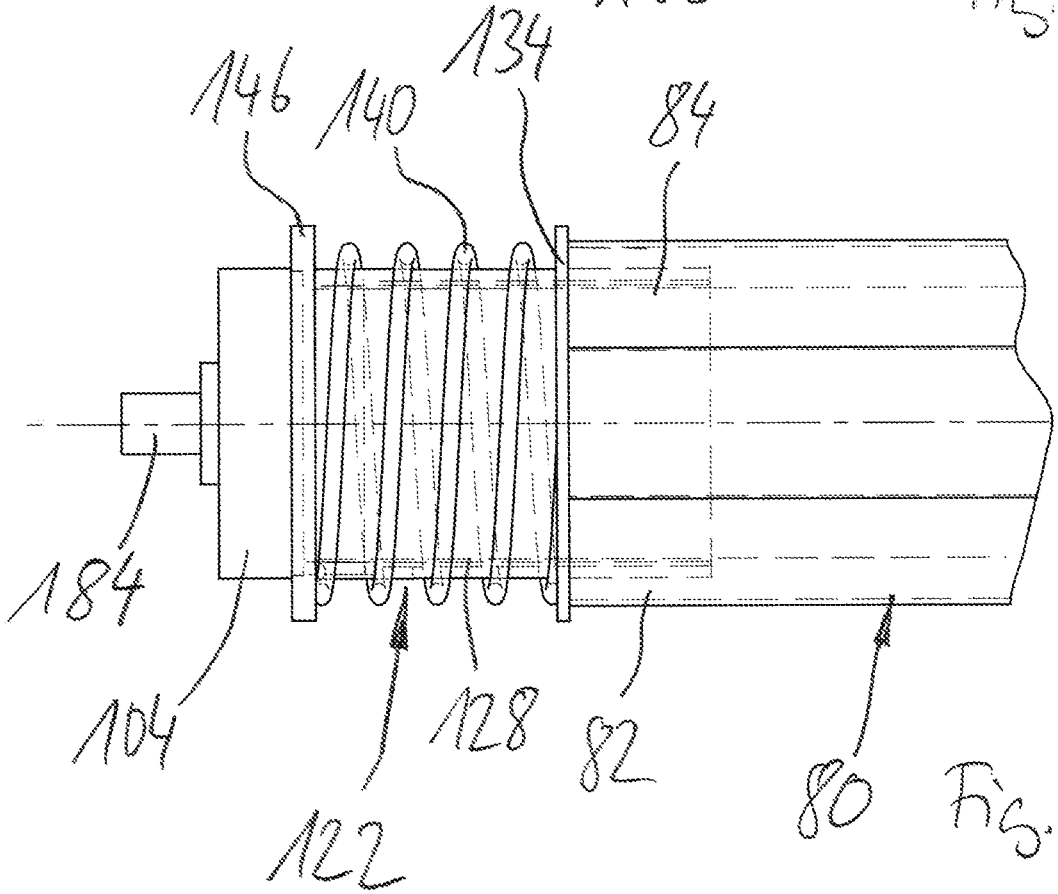
FIG. 5 shows the arrangement according to FIG. 4 in a second, retracted state of the mounting unit.

In FIG. 4, a double arrow designated by 184 illustrates the compensation/telescopic movement of the connecting sleeve 128 relative to the hollow section body 80. In FIG. 5, the connecting sleeve 128 and thus also the drive unit 90 are pushed into the hollow section body 80 to an extent which, for example, enables simple assembly or disassembly without tools.

It goes without saying that the assembly unit 120 (FIG. 2) may also be used in the same way for the first end 82 of the hollow section body 80, which is assigned to the first support bearing 76, in order to facilitate the assembly and disassembly of shaft assembly 74.

The assembly units 120, 122 are suitable for new assemblies as well as for upgrading or retrofitting existing shaft assemblies. The assembly units 120, 122 are characterized by a modular concept that reduces the variety of parts and variants, among other things.

Figure 6:
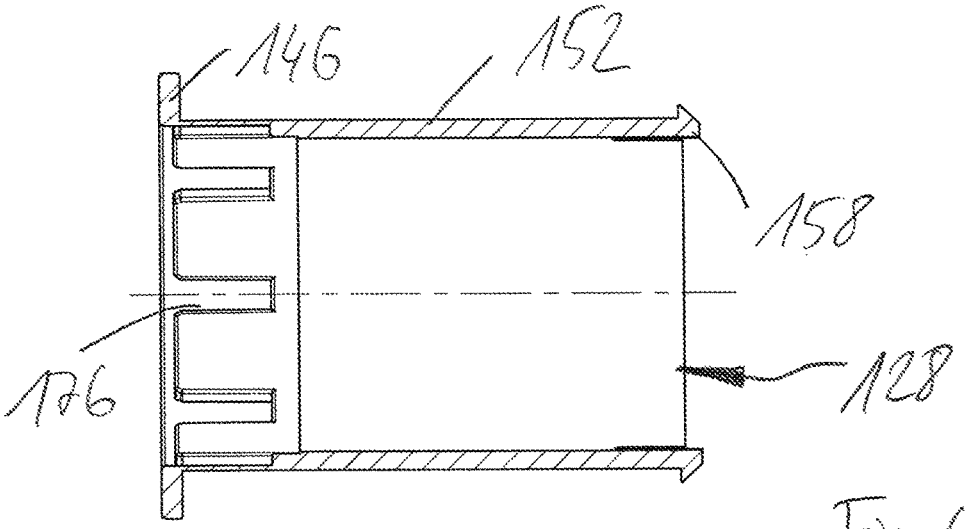
FIG. 6 is a lateral sectional view through an embodiment of a connecting sleeve.
Figure 7:
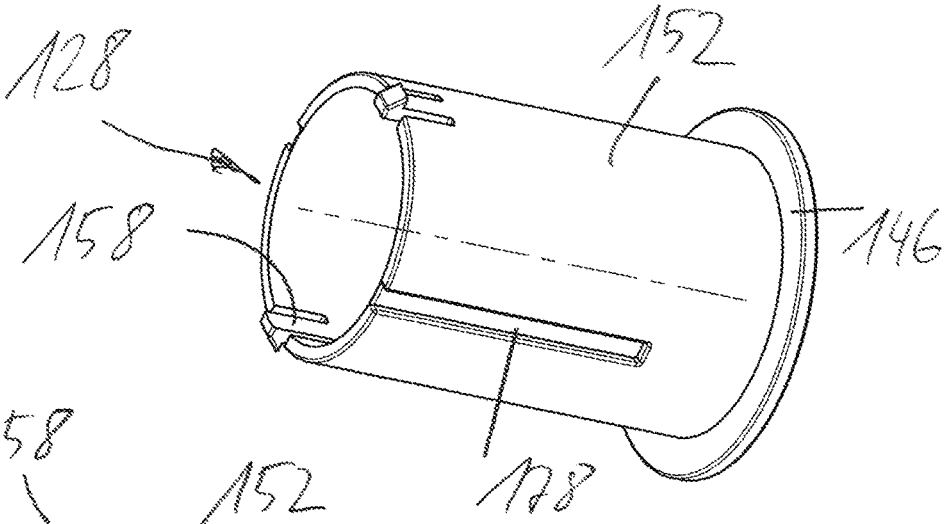
FIG. 7 is a perspective view of the connecting sleeve according to FIG. 6 in a first orientation.
Figure 8:
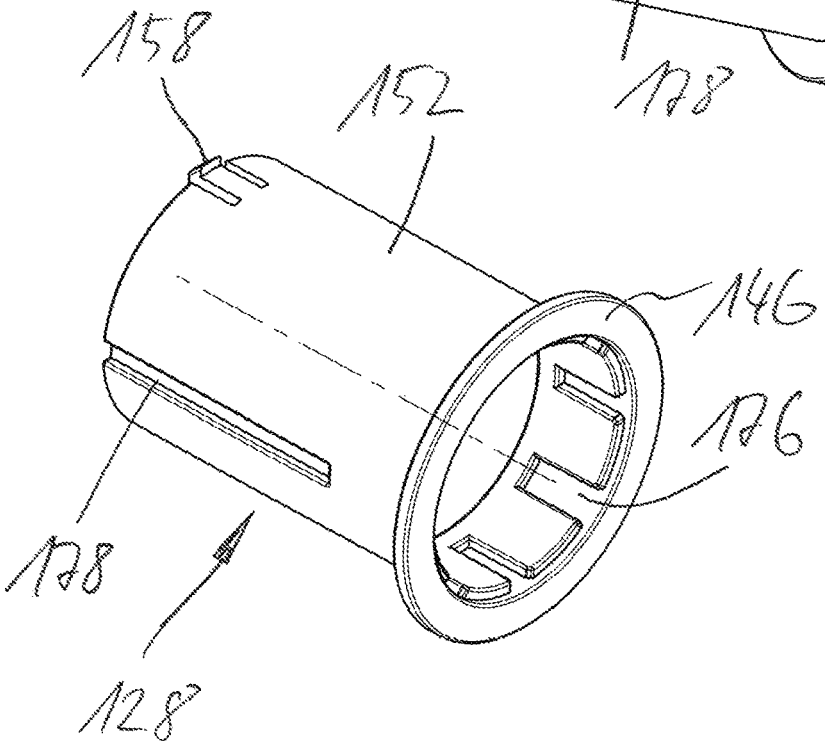
FIG. 8 is a perspective view of the connecting sleeve according to FIG. 6 in a second orientation.

With reference to FIGS. 6, 7 and 8, an exemplary design of a connecting sleeve 128 is illustrated, which is suitable for use with the second mounting unit 122.

The connecting sleeve 128 is shown in FIG. 6 in a sectional view. FIG. 7 and FIG. 8 show perspective views. FIG. 7 shows the end facing the hollow section body 80. FIG. 8 shows the end of the connecting sleeve 128 facing the second support bearing 78.

As already indicated above, the connecting sleeve 128 comprises a collar 146 and a tube segment 152. Snap hooks 158 are formed at the tube segment 152. At the end at which the collar 144 is formed, the connecting sleeve 128 comprises rotary driving elements 176 in the form of grooves which are designed to cooperate with rotary drive elements 174 on the rotary drive 108 of the drive unit 90, refer to FIG. 3 in this context.

In addition, at the tube segment 152 rotatory driving elements in the form of grooves 178 are formed, which cooperate with corresponding rotatory driving elements 180 of the pressure piece 134, refer again to FIG. 3. The rotary driving elements 176 are provided at the inner circumference of the connecting sleeve 128. The rotary driving elements 178 are provided at the outer circumference of the connecting sleeve 128.

Figure 9:
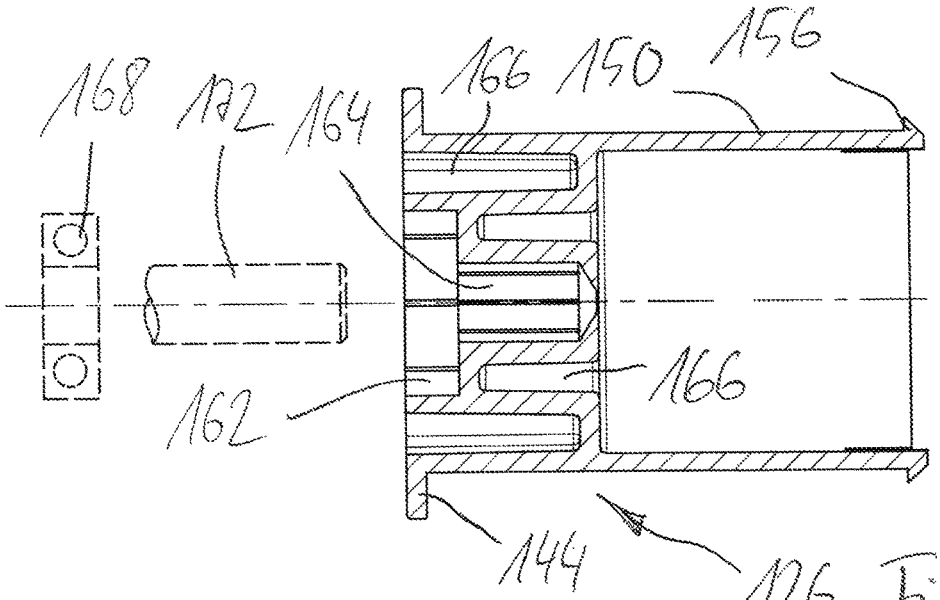
FIG. 9 is a lateral sectional view through another embodiment of a connecting sleeve.
Figure 10:
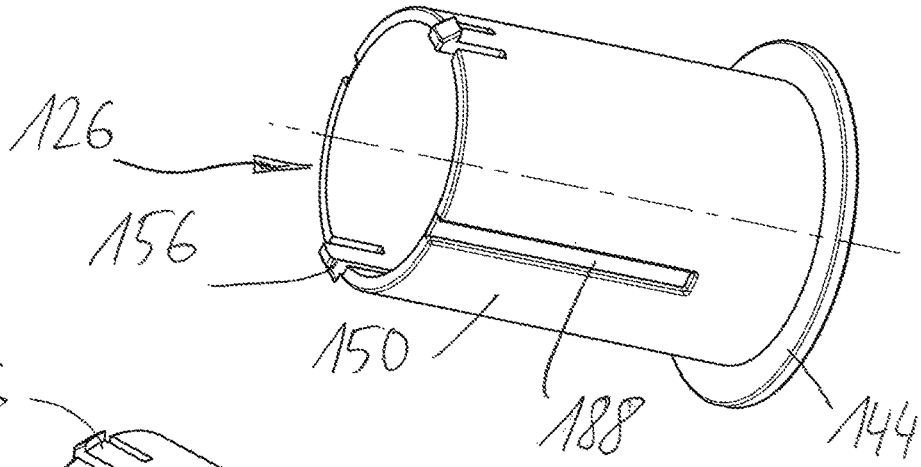
FIG. 10 is a perspective view of the connecting sleeve according to FIG. 9 in a first orientation.
Figure 11:
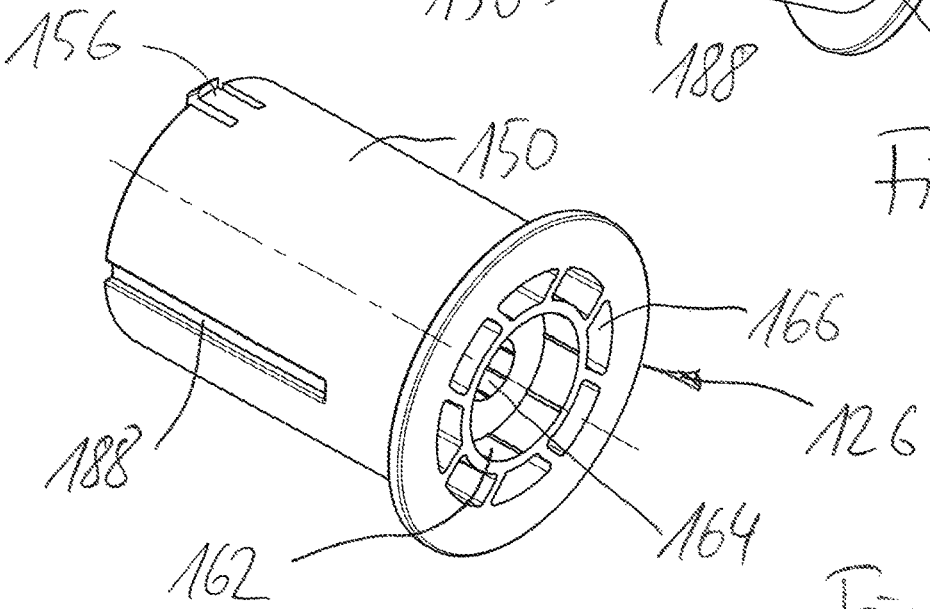
FIG. 11 is a perspective view of the connecting sleeve according to FIG. 9 in a second orientation.

With reference to FIG. 9, FIG. 10 and FIG. 11, an exemplary embodiment of a connecting sleeve 126 is illustrated, which may be used with the first mounting unit 120, which may be coupled to the first end 82 of the hollow section body 80, refer to FIG. 2.

FIG. 9 shows a longitudinal sectional view of the connecting sleeve 126. FIG. 10 shows a perspective view of the end of the connecting sleeve 126 that is facing the hollow section body 80. FIG. 11 shows a perspective view of the end of the connecting sleeve 126 that is facing the first support bearing 76.

The connecting sleeve 126 is provided with the collar 144 and the tube segment 150, similar to the exemplary embodiment already shown in FIG. 2, wherein at the tube segment 150 snap hooks 156 are formed. At its end facing the support bearing 76, the connecting sleeve 126 is provided with an interface. The connecting sleeve 126 comprises a bearing seat 162 on this end face into which a bearing 168 (see also FIG. 2) may be pushed in or pressed in. Furthermore, the connecting sleeve 126 comprises an axle socket 164, which may also be referred to as an axle support. The axle socket 164 is exemplarily arranged as a blind hole, and at least provided with a depth stop.

The bearing seat 162 and the axle socket 164 are concentrically aligned to one another. The bearing seat 162 and the axle socket 164 are axially offset from one another. Departing from the end of the flange 144 facing the support bearing 76, first the bearing seat 162 is provided. The bearing seat 162 is followed by the axle socket 164. The bearing seat 162 comprises a larger nominal dimension than the axle socket 164. Depending on the desired application and/or the given boundary conditions, the connecting sleeve 126 may thus be coupled with a bearing 168 or with an axis 172. In FIG. 9, the bearing 168 and the axis 172 are indicated in dashed lines for illustrative purposes. Hence, the connecting sleeve 126 is suitable for both mounting types shown in FIG. 1 and FIG. 2 at the first support bearing 14, 76.

FIG. 9 and FIG. 11 also show that various recesses 176 are provided. This ensures during injection molding that there are no excessive material accumulations, for instance.

With regard to its radial outer contour, the connecting sleeve 126 is very similar to the connecting sleeve 128. In tube segment 150, rotary driving elements 188 are provided in the form of longitudinal grooves, which correspond to the rotary driving elements 178 in the connecting sleeve 128.

Exemplary embodiments are conceivable in which the connecting sleeves 126, 128 are identical in the area of their outer circumference or their shell surface. This may enable a multiple use of mold halves in injection molding, for example. This reduces the tooling effort required. The snap hooks 156, 158 for the snap-lock connection with the pressure pieces 132, 134 may also be standardized accordingly.

The shape of the front end assigned to the respective collar 144, 146 may be formed by different interchangeable inserts. Hence, the tooling effort may be minimized.

As already mentioned above, it is possible to make the biasing elements 138, 140 and the pressure pieces 132, 134 similar or even identical for the two assembly units 120, 122. Such a unified design simplifies production, reduces logistics costs and generally improves the availability of the required components.

With reference to FIG. 12, FIG. 13, FIG. 14 and FIG. 15 an exemplary design of a pressure piece 134 is illustrated. It goes without saying that the pressure piece 132 may be designed identically. The pressure piece 134 may be used with both the assembly unit 120 and the assembly unit 122.

Figure 12:
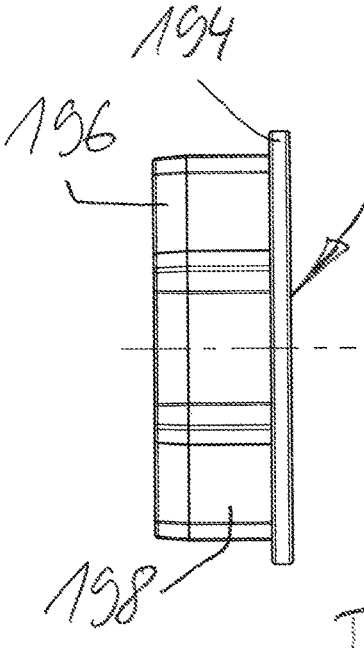
FIG. 12 is a lateral view of an embodiment of a pressure piece.
Figure 13:
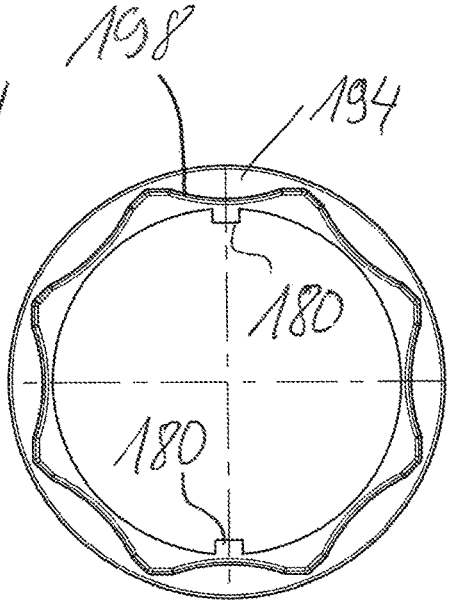
FIG. 13 is a frontal view of the pressure piece according to FIG. 12.
Figure 14:
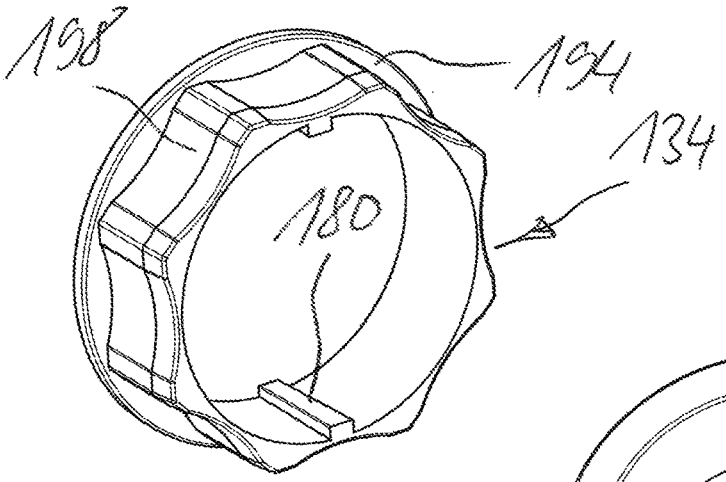
FIG. 14 is a perspective view of the pressure piece according to FIG. 12 in a first orientation.
Figure 15:
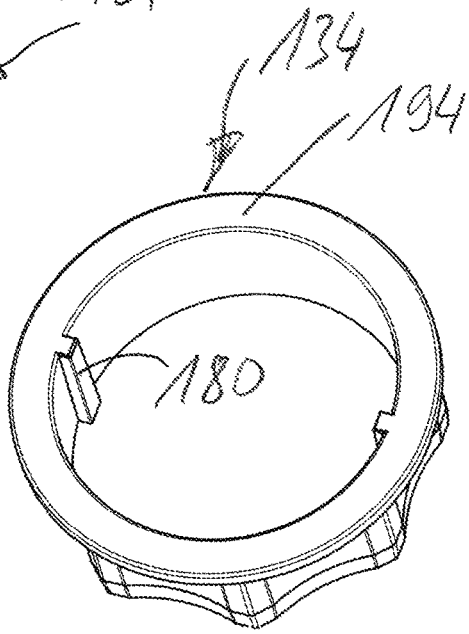
FIG. 15 is a perspective view of the pressure piece according to FIG. 12 in a second orientation.

FIG. 12 shows a side view of the pressure piece 134. FIG. 13 shows a frontal view of the pressure piece 134. FIG. 14 shows a perspective view of the end of the pressure piece 134, which is inserted into the hollow section body 80 in the mounted state. FIG. 15 shows a perspective view of the end of the pressure piece 134 which, in the mounted state, faces the respective support bearing 76, 78.

The pressure piece 134 comprises a collar 194, which may also be referred to as a shoulder. The pressure piece 134 comprises an insertion chamfer 196 at an end thereof facing away from the collar 194. This facilitates insertion into the respective boundary area of the hollow section body 80. Furthermore, FIGS. 12 to 15 show in conjunction that the axial extension of the pressure piece 134 is formed by a driving body 198, which extends from the collar 194 towards the insertion chamfer 196. The driving body 198 is provided with a contour that is adapted to an inner profile of the hollow section body 80.

It may also be seen from FIGS. 13, 14 and 15 that the pressure piece 134 comprises rotary drive elements 180 in the form of bars. The driving elements 180 are arranged to be coupled with the driving elements 178 on the connecting sleeve 128 and the driving elements 188 on the connecting sleeve 126 in order to enable a rotary drive.

A mounting kit may be formed from the elements 126, 128, 132, 134, 138, 140 in a simple manner to mount the shaft assembly 74. Such a mounting kit is basically also suitable as a repair means or upgrade means for existing shaft assemblies, refer the shaft assembly 24 in FIG. 1.

The assembly kit may comprise both assembly units 120, 122, i.e. a slidable connecting sleeve 126, 128 may be provided at both the first end 82 and the second end 84 of the hollow section body 80. As already mentioned above, however, it is also possible to provide only one of the two mounting units 120, 122 in the mounting kit. This may already significantly contribute to simplify assembly, too.

What is claimed is:

1. A shaft assembly for a covering or protective device, comprising a hollow section body arranged to be mounted between a first support bearing and a second support bearing, and a drive unit that is at least partially arranged in the hollow section body, wherein the hollow section body is rotatable about its longitudinal axis and arranged to accommodate a curtain or a panel of the covering or protective device, wherein the drive unit comprises an output for rotatably driving the hollow section body, wherein the hollow section body comprises a first end facing the first support bearing and a second end facing the second support bearing, wherein a connecting sleeve is provided at least at one of the first end or the second end of the hollow section body, wherein a biasing element is arranged between the hollow section body and the connecting sleeve, wherein the connecting sleeve is axially displaceable relative to the hollow section body against a force applied by the biasing element, wherein a pressure piece is arranged at the hollow section body, wherein the biasing element is supported at the pressure piece, wherein the pressure piece is coupled to a tube segment of the connecting sleeve, wherein the biasing element is arranged as a spring that is formed concentrically with respect to the tube segment of the connecting sleeve, and that is arranged outside of the tube segment, wherein the tube segment provides an axial guide for the pressure piece and the biasing element, and wherein the biasing element does not extend into the interior of the hollow section body when the connecting sleeve is at least partially inserted into the interior of the follow section body.

2. The shaft assembly as claimed in claim 1, wherein the connecting sleeve comprises a collar, and wherein the biasing element is supported at the collar via an end thereof that is facing away from the hollow section body.

3. The shaft assembly as claimed in claim 1, wherein the pressure piece is coupled to the hollow section body in a rotationally fixed manner, and wherein the pressure piece is coupled to the connecting sleeve in a rotationally fixed manner.

4. The shaft assembly as claimed in claim 1, wherein a snap connection is provided between the pressure piece and the connecting sleeve, which is arranged to couple the pressure piece to the connecting sleeve axially displaceable and secured against loss.

5. The shaft assembly as claimed in claim 1, wherein corresponding rotary driving elements are provided at the tube segment and at the pressure piece.

6. The shaft assembly as claimed in claim 1, wherein the connecting sleeve, the biasing element and the pressure piece do not project beyond an outer circumference or an envelope curve of the hollow section body.

7. The shaft assembly as claimed in claim 1, wherein the hollow section body is at the first end supported at the first support bearing via the connecting sleeve, and wherein the connecting sleeve comprises a receptacle arranged as one of a bearing seat, an axle socket, or a combined bearing seat and axle socket receptacle.

8. The shaft assembly as claimed in claim 1, wherein the hollow section body is at the second end supported at the drive unit via the connecting sleeve, and at the second support bearing via the drive unit.

9. The shaft assembly as claimed in claim 8, wherein the drive unit comprises a rotary driver that is coupled to the hollow section body for movement entrainment, and wherein the drive unit is coupled to a rotary position sensor unit that detects a rotational position of the rotary driver and compares it with a rotational position of the output.

10. The shaft assembly as claimed in claim 9, wherein the rotary driver comprises at least one rotary driving element that is coupled to the connecting sleeve for rotation entrainment.

11. The shaft assembly as claimed in claim 10, wherein the first end is supported at the first support bearing and the second end is supported at the drive unit, wherein the drive unit is supported at the second support bearing, wherein the output of the drive unit is coupled to the hollow section body for rotation entrainment via an adapter piece, and wherein the adapter piece is arranged inside the hollow section body.

12. The shaft assembly as claimed in claim 1, wherein the shaft assembly is incorporated in one of a roller shutter, a roller door and an awning.

13. A covering or protective device, comprising:

a first support bearing, a second support bearing, and a shaft assembly that is interposed between the first support bearing and the second support bearing, the shaft assembly comprising a hollow section body that is mounted between the first support bearing and the second support bearing, and a drive unit that is at least partially arranged in the hollow section body, wherein the hollow section body is rotatable about its longitudinal axis and arranged to accommodate a curtain or a panel of the covering or protective device, wherein the drive unit comprises an output for rotatably driving the hollow section body, wherein the hollow section body comprises a first end facing the first support bearing and a second end facing the second support bearing, wherein a connecting sleeve is provided at least at one of the first end and the second end of the hollow section body, wherein a biasing element is arranged between the hollow section body and the connecting sleeve, wherein the connecting sleeve is axially displaceable relative to the hollow section body against a preloading force that is applied by the biasing element, such that the shaft assembly is for mounting purposes axially telescopic against the preloading force, wherein a pressure piece is arranged at the hollow section body, wherein the biasing element is supported at the pressure piece, wherein the pressure piece is coupled to a tube segment of the connecting sleeve, wherein the biasing element is arranged as a spring that is formed concentrically with respect to the tube segment of the connecting sleeve, and that is arranged outside of the tube segment, wherein the tube segment provides an axial guide for the pressure piece and the biasing element, and wherein the biasing element does not extend into the interior of the hollow body when the connecting sleeve is at least partially inserted into the interior of the hollow section body.

14. The covering or protective device as claimed in claim 13, the device being arranged as one of a roller shutter, a roller door, or an awning.

* * * * *